US008235729B2

(12) United States Patent
Wang et al.

(10) Patent No.: US 8,235,729 B2
(45) Date of Patent: Aug. 7, 2012

(54) CONNECTOR

(75) Inventors: Hung-Chi Wang, Taipei (TW); Mei-Chuan Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 104 days.

(21) Appl. No.: 12/968,597

(22) Filed: Dec. 15, 2010

(65) Prior Publication Data

US 2012/0156904 A1 Jun. 21, 2012

(51) Int. Cl.
*H01R 12/00* (2006.01)

(52) U.S. Cl. ..... 439/64; 439/571

(58) Field of Classification Search ..... 439/64, 439/571, 572, 566, 160, 159
See application file for complete search history.

(56) References Cited

U.S. PATENT DOCUMENTS

| | | | | |
|---|---|---|---|---|
| 4,943,244 | A * | 7/1990 | Teck et al. | 439/567 |
| 5,297,966 | A * | 3/1994 | Brennian et al. | 439/64 |
| 6,129,562 | A * | 10/2000 | Hong | 439/79 |
| 6,319,017 | B1 * | 11/2001 | Kuo | 439/64 |
| 6,540,540 | B1 * | 4/2003 | Tobey | 439/327 |

* cited by examiner

*Primary Examiner* — Hien Vu
(74) *Attorney, Agent, or Firm* — WPAT, P.C.; Anthony King

(57) ABSTRACT

A connector has an insulating housing of which two opposite ends extended frontward to form a pair of supporting arms, terminals mounted in the insulating housing having soldering portions projected out of a bottom of the insulating housing, and a positioning member. The positioning member has a base slice. A rear of a side edge the base slice is extended downward to form a holding slice movably received in a through slot recessed at the supporting arm. A front of the side edge of the base slice is extended downward and then bent perpendicularly to form a soldering slice. As the height between the base slice and the soldering slice is bigger than that of the supporting arm, the positioning member is capable of moving up-and-down to adjust the relative position between the soldering slice and the soldering portions of the terminals.

4 Claims, 3 Drawing Sheets

CONNECTOR

BACKGROUND OF THE INVENTION

1. Field of the Invention

The present invention relates to a connector, and more particularly to a connector capable of ensuring a steady connection between terminals thereof and a printed circuit board (PCB).

2. The Related Art

Referring to FIGS. 4-5, a conventional connector 100' has an insulating housing 10', a plurality of terminals 20' mounted in the insulating hosing 10' and each having a soldering portion 21' projecting out of a bottom of the insulating housing 10' for being soldered with a PCB, a pair of latch members 30' mounted in two opposite ends of the insulating housing 10' and further projecting forward out of the insulating housing 10', and a pair of positioning members 40' mounted on fronts of the latch members 30' respectively. The positioning member 40' has a pair of soldering plates 41' and a fixing portion 42' of substantially inverted-U shape linking the two soldering plates 41'. The soldering plates 41' are soldered with the PCB so as to fix the latch member 30' with the PCB. However, it is difficult to keep the two soldering plates 41' to be always level with the soldering portions 21' due to the tolerance in production.

SUMMARY OF THE INVENTION

Accordingly, an object of the present invention is to provide a connector soldered to a PCB. The connector has an insulating housing having a base of which two opposite ends extend frontward to form a pair of supporting arms, a plurality of terminals mounted in the insulating housing, and a positioning member movably mounted to the supporting arm. The supporting arm defines a through slot vertically penetrating through a top thereof. The terminal has a soldering portion projecting out of a bottom of the base for being soldered with a PCB. The positioning member has a base slice located on the supporting arm. A rear of a side edge of the base slice is extended downward to form a holding slice movably inserted in the through slot of the supporting arm. A front of the side edge of the base slice is extended downward and then being bent perpendicularly to form a soldering slice located to be lower than the bottom of the supporting arm for being soldered on the PCB. As the height between the base slice and the soldering slice is bigger than that of the supporting arm to make the soldering slice always located to be lower than the bottom of the supporting arm and further achieve an up-and-down movement of the positioning member, so as to adjust a relative position between the soldering slice and the soldering portions of the terminals.

As described above, while the positioning member is assembled to the supporting arm, the soldering slice is located to be lower than the bottom of the supporting arm, as the height between the base slice and the soldering slice is bigger than that of the through slot. As a result, the positioning member is capable of moving up-and-down to adjust the relative position between the soldering slice and the soldering portions of the terminals and further ensure the soldering portion capable of being always soldered with the PCB, even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
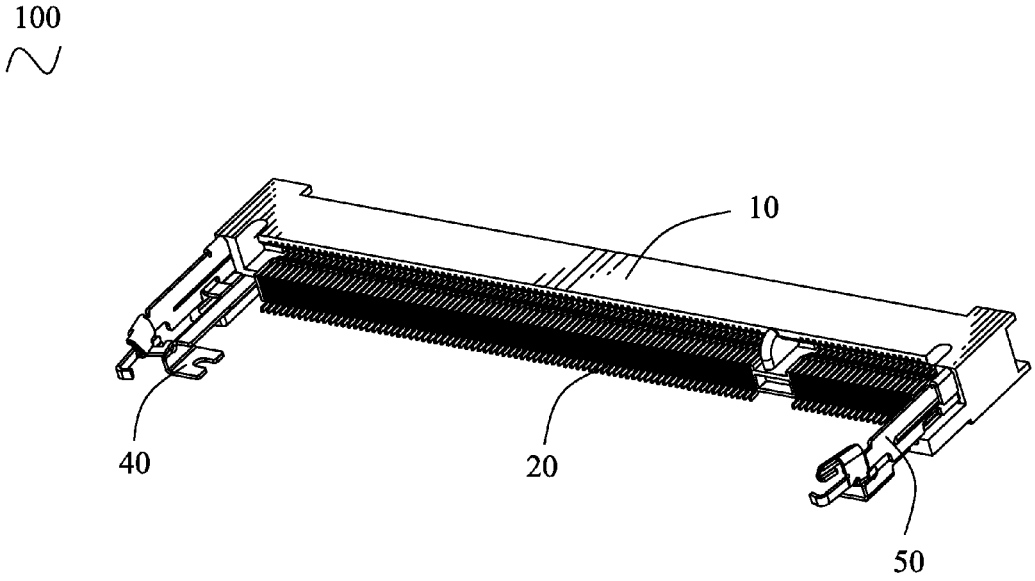
FIG. 1 is an assembled, perspective view of a connector of an embodiment in accordance with the present invention.
Figure 2:
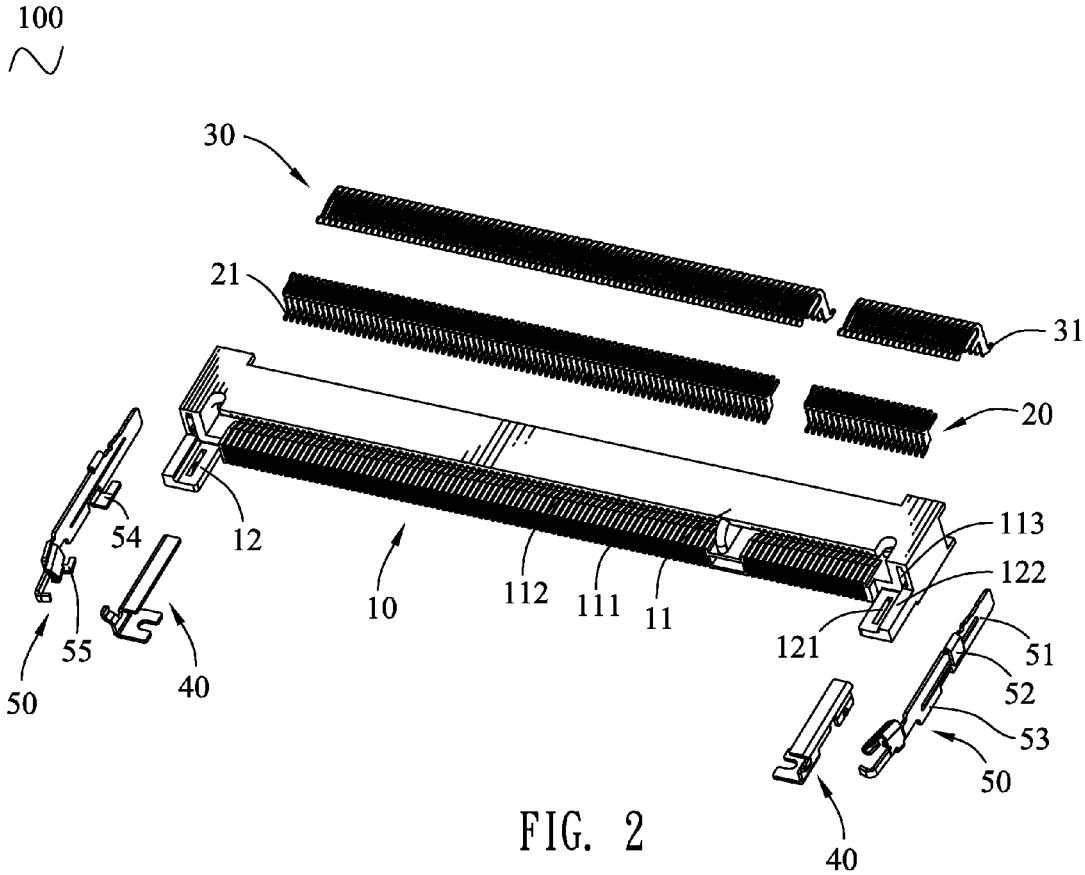
FIG. 2 is an exploded, perspective view of the connector shown in FIG. 1.

Referring to the drawings in greater detail, and first to FIGS. 1-2, the embodiment of the invention is embodied in a connector 100. The connector 100 has an insulating housing 10, a plurality of first terminals 20 and second terminals 30 mounted in the insulating housing 10, a pair of latch members 50 assembled to two opposite ends of the insulating housing 10, and a pair of positioning members 40 movably mounted to the two opposite ends of the insulating housing 10.

With reference to FIGS. 1-2, the insulating housing 10 has a long rectangular base 11. A lower part of a front of the base 11 defines a plurality of first terminal grooves 111 arranged at regular intervals along a longwise direction of the base 11. An upper portion of the base 11 defines a plurality of second terminal grooves 112 arranged at regular intervals along the longwise direction of the base 11. The front of the base 11 has two opposite ends extended frontward to form a pair of supporting arms 12 having bottoms substantially level with that of the base 11. The supporting arm 12 defines a through slot 121 extending forward and rearwards and vertically penetrating a top and a bottom of the supporting arm 12. An outside edge of the top of the supporting arm 12 is protruded upward to form a protrusion platform 122 extending along the extension direction of the supporting arm 12 and located besides the through slot 121. The two opposite ends of the front of the base 11 are recessed rearward to form a pair of fixing recesses 113 each having a bottom side level with a top of the protrusion platform 122.

The first terminals 20 are disposed in the corresponding first terminal grooves 111 of the insulating housing 10, and each has a first soldering portion 21 projecting out of the bottom of the base 11 for being soldered with a PCB (not shown). The second terminals 30 are respectively disposed in the second terminal grooves 112 of the insulating housing 10, and each has a second soldering portion 31 projecting out of the bottom of the base 11 for being soldered with the PCB.

Figure 3:
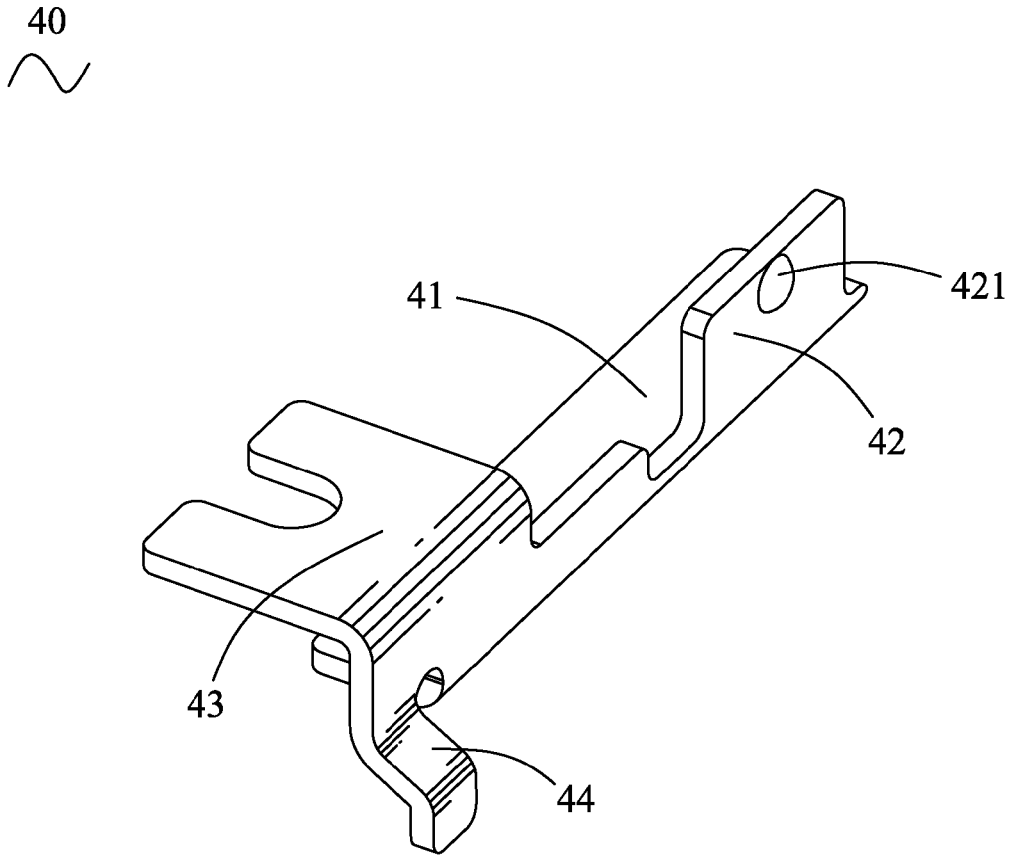
FIG. 3 is a perspective view of a positioning member of the connector shown in FIG. 2.
Figure 4:
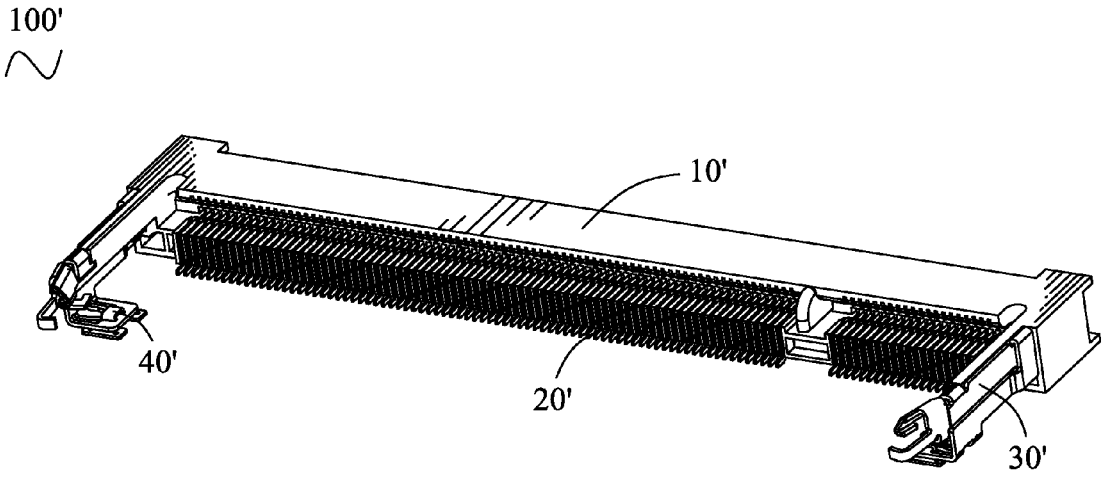
FIG. 4 (Prior Art)
FIG. 4 is an assembled, perspective view of a conventional connector.
Figure 5:
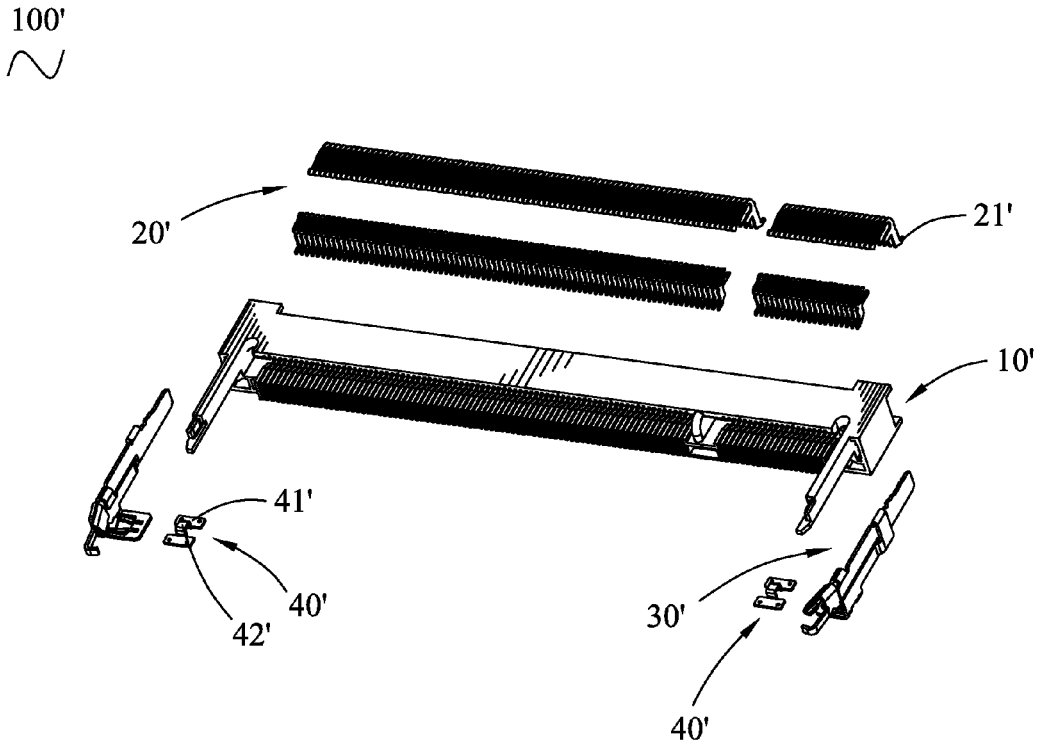
FIG. 5 (Prior Art)
FIG. 5 is an exploded, perspective view of the conventional connector shown in FIG. 4.

Referring to FIG. 3, the positioning member 40 has a long rectangular base slice 41. A rear of one side edge of the base slice 41 extends downward to form a holding slice 42. The holding slice 42 is inserted in the through slot 121 of the insulating housing 10. The holding slice 42 has a bump 421 protruded at a lateral side thereof for interfering with one side of the through slot 121. A front of the one side edge of the base slice 41 extends downward and then is perpendicularly bent towards the same direction as the base slice 41 to form a soldering slice 43. The height between the base slice 41 and the soldering slice 43 is bigger than that of the supporting arm 12. A front end of the base slice 41 is punched off to have only one side edge connected with the soldering slice 43, and then is bent upward to form a stopping portion 44 of hook shape substantially perpendicular to the base slice 41.

Please refer to FIG. 2 again. The latch member 50 has a long rectangular base plate 53. A rear of the base plate 53 extends rearward to form a fixing portion 51. A portion of a top edge of the base plate 53 adjacent to the fixing portion 51 is bent sideward and then extends downward to form a folded plate 52 facing the base plate 53. A rear of a bottom edge of the base plate 53 perpendicularly extends towards the other side of the base plate 53 opposite to the folded plate 52 to form a stopping plate 54. A front of the bottom edge of the base plate 53 extends toward the same direction as the stopping plate 54 and then is bent rearward to form a L-shaped restraining portion 55.

In assembly, the positioning member 40 is movably mounted in the supporting arm 12 with the holding slice 42 movably inserted in the through slot 121, the bump 421 being against a corresponding side of the through slot 121 and a rear of the base slice 41 located on the supporting arm 12. While the holding slice 42 is inserted in the through recess 121, the soldering slice 43 is located to be lower than the bottom of the supporting arm 12 for being soldering with the PCB, as the height between the base slice 41 and the soldering slice 43 is bigger than that of the supporting arm 12. As a result, while the soldering portions 21, 31 are not level with the bottom of the supporting arm 12, the positioning member 40 is capable of moving up-and-down so as to adjust a relative position 43 of the soldering slice 43 and the soldering portions 21, 31 of the terminals 20, 30 by means of the holding slice 42 moving up-and-down in the through slot 121. In the process of the positioning member 40 moving up-and-down, the bump 421 interferes with the corresponding side of the through slot 121 to prevent the holding slice 42 from moving out of the through slot 121. The fixing portion 51 of the latch member 50 is inserted rearward into the fixing recess 113 of the insulating housing 10 until the folded plate 52 rests against the front of the base 11 to prevent the latch member 50 further going into the fixing recess 113. At this time, the base plate 53 of the latch member 50 is supported by the protrusion platform 122. The stopping plate 54 is located over the base slice 41 of the positioning member 40 for restraining the holding slice 42 in the through slot 121. The stopping portion 44 is engaged with the L-shaped restraining portion 55 for avoiding the deformation of the front of the latch member 50 while an external card (not shown) is inserted into the connector 100 by means of the stopping portion 44 hooking the restraining portion 55 downward.

As described above, while the positioning member 40 is assembled to the supporting arm 12, the soldering slice 43 is located to be lower than the bottom of the supporting arm 12 as the height between the base slice 41 and the soldering slice 43 is bigger than that of the supporting arm 12. As a result, the positioning member 40 is capable of moving up-and-down to adjust the relative position between the soldering slice 43 and the soldering portions 21, 31 of the terminals 20, 30 and further ensure the soldering portion 21, 31 capable of being always soldered with the PCB, even when there is tolerance in production.

What is claimed is:

1. A connector soldered to a PCB, comprising: an insulating housing having a base of which two opposite ends extend frontward to form a pair of supporting arms, each of the supporting arms defining a through slot vertically penetrating through a top thereof; a plurality of terminals assembled in the base of the insulating housing, each of the terminals having a soldering portion projecting out of a bottom of the base for being soldered on the PCB; and a positioning member, each of the positioning members movably mounted to each of the supporting arms, the positioning member having a base slice located on the supporting arm, a rear of a side edge of the base slice extending downward to form a holding slice movably inserted in the through slot of the supporting arm, a front of the side edge of the base slice extending downward and then being perpendicularly bent to form a soldering slice located to be lower than the bottom of the supporting arm for being soldered on the PCB, wherein the height between the base slice and the soldering slice is bigger than that of the supporting arm to make the soldering slice always located to be lower than the bottom of the supporting arm and further achieve an up-and-down movement of the positioning member, so as to adjust a relative position between the soldering slice and the soldering portions of the terminals;

wherein a pair of latch members each has a base plate and a fixing portion extending rearward from a rear end of the base plate, the fixing portion being press fitted into a fixing recess opened in one end of the insulating housing and the base plate being supported by the base plate, a rear end of a top edge of the base plate being bent sideward and then extending downward to form a folded plate resting against a front of the base for preventing the latch member further going into the fixing recess; and wherein each of the positioning members engages each of the latch members.

2. The connector as claimed in claim 1, wherein a bump is protruded at a lateral side of the holding slice for interfering with one side of the through slot in process of the positioning member moving up-and-down.

3. The connector as claimed in claim 1, wherein a bottom edge of the base plate extends perpendicularly to form a stopping plate located over the base slice of the positioning member for restraining the holding slice in the through slot.

4. The connector as claimed in claim 1, wherein a front end of the base slice punched off to have only one side edge connected with the soldering slice, and then is bent upward to form a stopping portion of hook shape substantially perpendicularly to the base slice, a front end of a bottom edge of the base plate extends sideward and then is bent rearward to form a L-shaped restraining portion engaged with the stopping portion for avoiding the deformation of the front of the latch member.

* * * * *